US005318470A

United States Patent [19]

Denny

[11] Patent Number: 5,318,470

[45] Date of Patent: Jun. 7, 1994

[54] MODULAR CONSTRUCTION ASSEMBLY

[76] Inventor: Wayne H. Denny, 1348 Ralston St., Reno, Nev. 89503

[21] Appl. No.: 40,001

[22] Filed: Mar. 30, 1993

[51] Int. Cl.[5] ..... A63H 33/08

[52] U.S. Cl. ..... 446/126; 52/655.2

[58] Field of Search ..... 446/126, 124; 434/277, 434/278, 281; 52/653.2, 655.2

[56] References Cited

U.S. PATENT DOCUMENTS

| | | | |
|---|---|---|---|
| 1,113,371 | 10/1914 | Pajeau . | |
| 3,176,428 | 4/1965 | Slingluff | 446/126 X |
| 3,600,825 | 8/1971 | Pearce | 446/126 X |
| 3,604,130 | 9/1971 | Forsstrom | 434/278 |
| 4,271,628 | 6/1981 | Barlow . | |
| 4,302,900 | 12/1981 | Rayner | 446/126 X |
| 4,701,131 | 10/1987 | Hildebrandt et al. | 446/126 X |
| 4,787,191 | 11/1988 | Shima | 52/648 |
| 5,049,105 | 9/1991 | Glickman | 446/126 |
| 5,137,486 | 8/1992 | Glickman | 446/126 |

OTHER PUBLICATIONS

"Orbit molecular building system" R.J.M. Exports Ltd., Oxford, England ©1971, p. 3.

*Primary Examiner*—Mickey Yu

*Attorney, Agent, or Firm*—Richard C. Litman

[57] ABSTRACT

A modular building assembly is disclosed. The assembly consists of connecting hubs fixedly interconnected with tubular members. The hubs are each made up of one generally circular, central ring and two semi-hemispheric portions or lobes, the ring and lobes being mutually and adjustably engageable. The outer surfaces of the ring and lobes have a plurality of rounded protrusions or apertures that are adapted to engage or receive the hollow ends of the tubular members. In one embodiment, the inner ring has a central, circular aperture therethrough that can also receive a tubular member, the aperture being dimensioned to engage the outer surface of the tubular member.

6 Claims, 2 Drawing Sheets

MODULAR CONSTRUCTION ASSEMBLY

BACKGROUND OF THE INVENTION

1. Field of the Invention

The present invention relates to a modular construction assembly. More specifically, it relates to a modular construction assembly that is particularly well adapted to be used as an educational toy. Even more specifically, it relates to a modular assembly where the connection hub consists of three interengageable pieces: a generally ring shaped central piece and two semi-hemispherical lobes. The three pieces have, on their outer surfaces, rounded protruding members adapted to fit inside hollow tubes, holding them firmly in place to create geometric shapes, models, or on a larger scale, temporary structures.

2. Description of the Prior Art

The desire to create pleasing shapes is one of the first impulses that humans develop as they grow. Nurseries and schools from antiquity have had, as part of their equipment, objects on hand to allow and encourage this impulse. Building blocks and the like are a well known and familiar device from almost everyone's childhood. Popsicle sticks and glue are another memory that most adults who have grown up in the Western Hemisphere or Europe will have in common. As children get older, the abstract or geometrical objects they envisage become more complex. This can require models that not only allow for the realization of these abstract entities, but additionally these models can impose a spatial hierarchy of some sort by a set relation between angles and distances in the interengaging pieces to encourage the recognition of patterns in three-dimensional space and an appreciation for planning. A number of inventions direct themselves at this educational challenge.

In U.S. Pat. No. 1,113,371 issued on Oct. 13, 1914 to Charles H. Pajeau, there is disclosed an improvement in toy construction. There are shown disks with sockets spaced about their peripheries that engage with rods to form structures. The rods have slits cut into their extreme ends to allow for a secure fit in the disk sockets.

In U.S. Pat. No. 4,271,628 issued on Jun. 9, 1981 to John V. Barlow we see a geometric construction toy apparatus. In this invention there are a number of substantially spherical connector members that have, arranged about their central point, a plurality of radial sockets or protrusions spaced in a predetermined pattern and referred to as "first order, second order, third order, and fourth order" depending on the configuration desired. This allows for the construction of various geometric shapes when connecting members are affixed between the connectors.

Next is U.S. Pat. No. 4,701,131 issued on Oct. 20, 1987 to Paul R. Hildebrandt et al. In this patent we see a group of nodes in the shape of rhombicosidodecahedrons. The elements that make up the surface of the nodes have radially and inwardly converging openings. These openings are shape coded and are adapted to receive likewise shape coded struts, thus allowing for the construction of various geometrical objects.

Another patent of interest is U.S. Pat. No. 4,787,191 issued on Nov. 29, 1988 to Hiroshi Shima. In this document there are disclosed elements for constructing a three-dimensional structure. There are various joints disclosed. Of particular interest are the full circled and semi-circled joints denoted, respectively, 1 and 2. The full circled joint has an annular core and six arms spaced radially about it. The annular core has a pair of opposing angular notches that allow two full circle joints to be mounted in a cruciform configuration, shown in FIG. 5.

U.S. Pat. No. 5,049,105 issued on Sep. 17, 1991 to Joel I. Glickman shows a connecting element for a construction toy where connections are provided in two planes, the planes being at right angles to one another.

Lastly, U.S. Pat. No. 5,137,486 issued on Aug. 11, 1992, also to Joel I. Glickman, shows a hub connector for tubes in a toy construction set. The connector elements disclosed have hub cylinders surrounded by a flange wall that, in the preferred embodiment, is octagonal in shape. Both the cylinder and the wall are integrally connected by a flat thin web. Each of the faces of the octagonal body formed by the cylinder, web, and wall further integrally mounts a radially extending mounting lug that is adapted to be received internally by tubular structural elements.

None of the above inventions and patents, taken either singly or in combination, is seen to describe the instant invention as claimed.

SUMMARY OF THE INVENTION

Accordingly, it is a principal object of the invention to provide a modular building assembly wherein the connector hubs are formed of a generally circular, central ring and two identical hemispheric portions or lobes, each engageable with an opposite side of the ring.

It is another object of the invention to provide a modular building assembly wherein rounded protrusions adapted to engage with hollow connecting rods are spaced about the outer surface of both the central ring and the hemispheric portions.

It is a further object of the invention to provide a modular building assembly wherein the connector hubs are easily manufactured by injection molding or casting from a plastic or rubber material.

Still another object of the invention is to provide a modular building assembly that is suitable for use by children to create pleasing geometric shapes of various sizes and complexity.

It is still yet another object of the invention to provide a modular building assembly that could be used to create lightweight and portable temporary structures for use in military operations, relief efforts, or other situations where light, quickly assembled shelters are desired.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a modular assembly that can be used both as a toy and as a way to inexpensively and easily provide a lightweight portable shelter.

Figure 3:
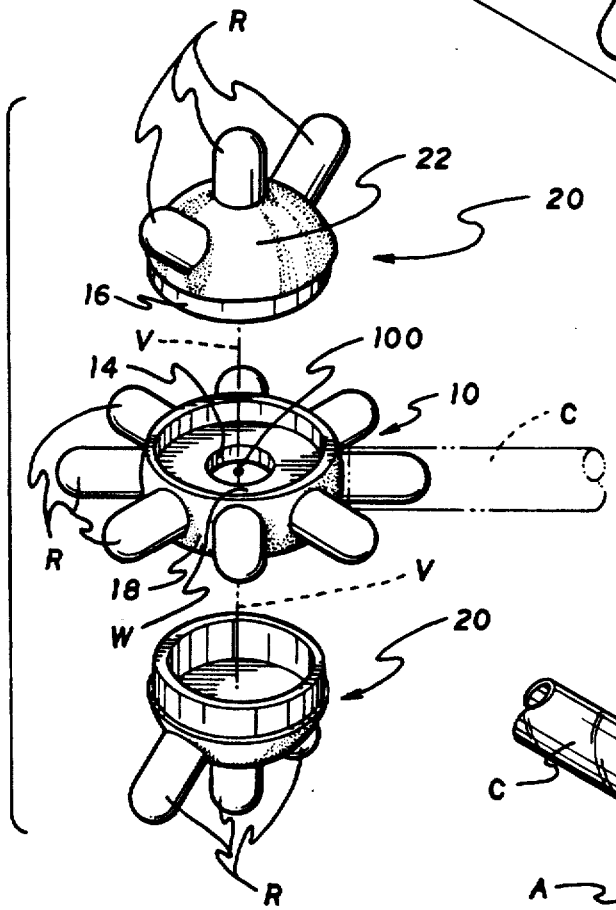
FIG. 3 is an exploded view of a connecting hub showing the generally circular inner ring, the central aperture therein, and two of the semi-hemispherical portions engageable thereto.
Figure 4:
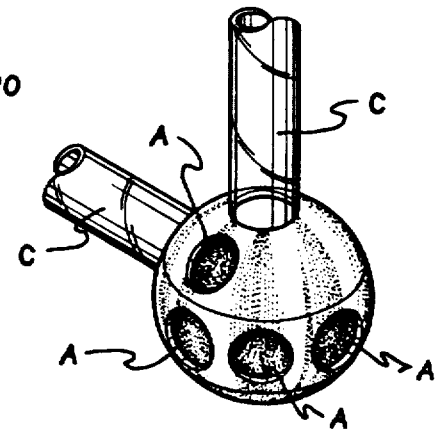
FIG. 4 is a perspective view of a second embodiment of the invention having apertures instead of protrusions for receiving the tubular members.

Referring to FIG. 3, the details of the connecting hub H are shown. There is an generally circular inner ring 10 that has an annular outside face 18, a central, generally circular aperture defining an opening 14 in the inner wall W, and two flanges 12, one on either side of an imaginary plane regular to the wall W and perpendicular to the vertical axis V, which passes centrally through the opening 14. The flanges 12 are adapted to engage the indented portions 16 of the semi-hemispherical portions 20. When the ring 10 and semi-hemispheric lobes 20 are joined together, they form a connecting hub H that has a center point 100. The semi-hemispherical portions 20 are identical to one another and further include an outer semi-hemispheric wall 22. On both the outer semi-hemispheric walls 22 and the annular outside face 18 of, respectively, the semi-hemispheric portions 20 and the inner ring 10, there are a plurality of rounded protrusions R. These rounded protrusions are of an appropriate thickness and length (this length being measured axially from the center 100 of the assembled connecting hub H) to be engageable with tubular connecting members C. It is to be understood that the members C must have, at least at the ends where they would engage with the protrusions R, an inner surface C'. Thus, the connecting members C would either be hollow throughout their length or would be hollow only at their extreme ends, the hollows being of a sufficient depth to completely and satisfactorily, frictionally engage the protrusions R. In the preferred embodiment of the invention, the protrusions on the inner ring 10 are spaced on the outside face 18 thereof at approximately 45° intervals. The protrusions R on the semi-hemispheric portions are spaced so that one of them would be located at the apex of the outer semi-hemispherical wall 22 if the semi-hemispheric portion 20 was oriented with the indented portion 16 downwards. In this preferred embodiment, the other two of the protrusions R on the semi-hemispherical wall 22 of the semi-hemispherical portion 20 are at an approximately 45° angle from the first protrusion and are situated so that all three lie generally in a common plane that they share with the center 100. Other arrangements of the protrusions R, not only on the semi-hemispherical portions 20, but on the inner ring 10, could be provided. As seen in FIG. 4, the protrusions could alternatively be apertures A adapted to receive the ends of the tubular members C.

Figure 1:
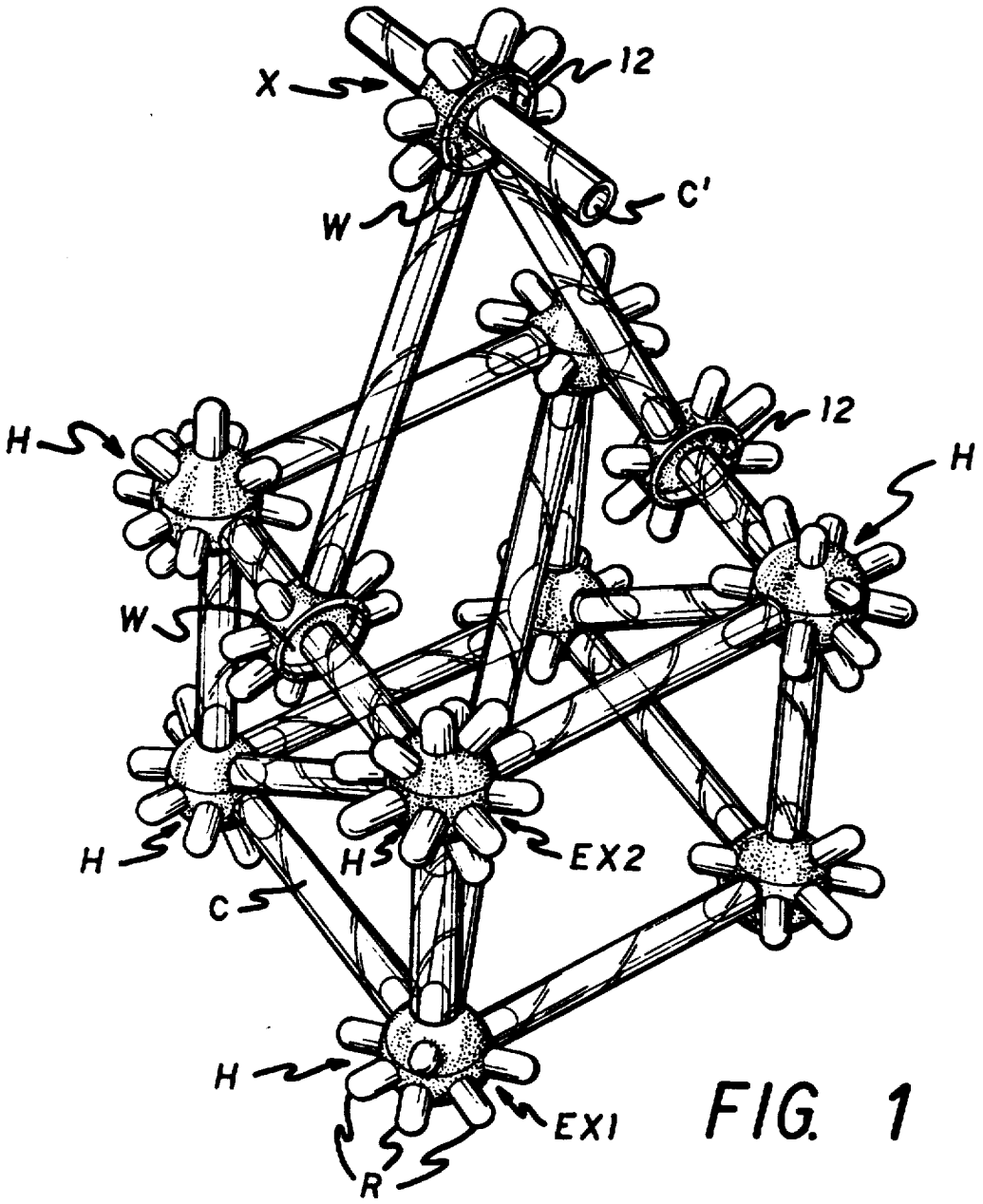
FIG. 1 is a perspective view showing an example of a structure assembled according to the present invention.
Figure 2:
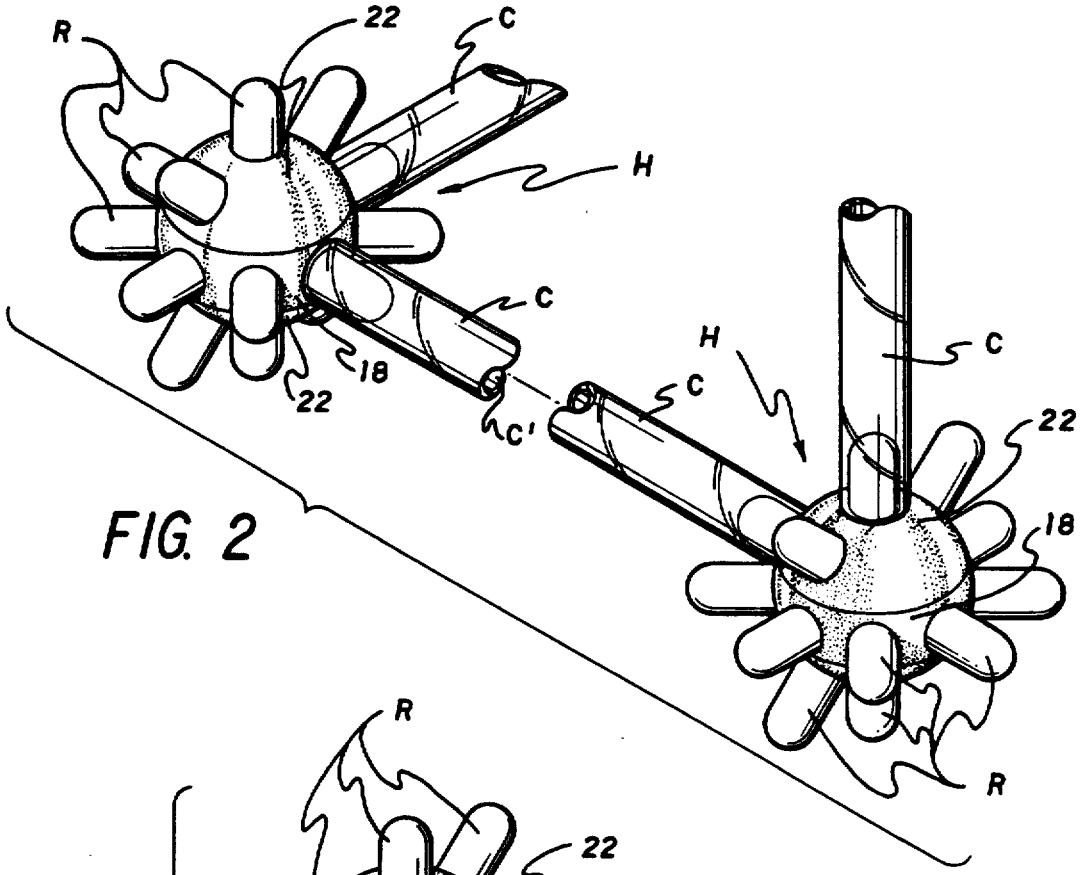
FIG. 2 is a an enlarged view of two of the three part connector hubs with tubular connecting members engaged with various of the rounded protrusions thereon.

In use, the modular assembly can form a large number of various shapes. Two of the semi-hemispheric portions 20 are joined to one of the inner rings 20 to form a connecting hub H. This is accomplished, in the preferred embodiment, by frictional engagement between the flanges 12 and the indented portions 16. One of the features of this type of assembly is that the protrusions R on each of the semi-hemispheric portions can be rotated independently of one another and independently of the inner ring 10. This is shown in FIG. 1 at EX1 and EX2, where the common planes of each set of the three protrusions extending from the upper semi-hemispherical portions of each of the indicated connecting hubs H are at 90° angles to one another. This allows a much wider variety of shapes to be realized within the angular and spatial limitations of the system. It also should be noted that the connecting hubs H need not necessarily be made up of all three pieces that are shown in FIG. 3. In FIG. 1, at X, there is shown an alternative connecting hub, made up of a single inner ring 10 connected by two of the protrusions R to a pair of the tubular connecting members C and having a third connecting member C, inserted through its central aperture 14. Though not shown in the drawings, an inner ring 10 and a semi-hemispherical portion 20 could be connected in the normal manner to one another and would function as yet another alternative type of connecting hub.

The connecting hubs H could be made out of a variety of materials, depending on the intended use. For the purpose of entertainment or education, i.e. a toy, a soft resilient rubber or light injection molded plastic of some sort could be used. The tubular connecting members for this use could then be made out of a sufficiently rigid and light plastic, either transparent or opaque, and could be colored to enhance the aesthetic appearance of the structures created. In circumstances where it is desired to build a lightweight, temporary shelter utilizing the present invention, the components would, of course, have to be made of heavier materials. There are sufficiently rigid plastics from which the components of the connecting hubs could be made and before the two semi-hemispherical portions 20 are engaged with the inner ring 10, an industrial glue or the like could be spread on the mating surfaces 12, 16 to permanently fix them in relation to one another. Additionally, threaded fasteners (not shown) could be used by simply drilling a hole through the tubular member and rounded protrusion after they are engaged with one another, inserting a nut and then tightening a bolt down on it. In this use of the current invention, the tubular connecting members C would also be constructed of a correspondingly heavier material such as PVC piping, EMT conduit, or the like having an appropriate diameter. Once the structure is assembled, if more static weight is needed, a hole (not shown) could be drilled in one or more of the tubular members C to allow the hollow space therein to be filled with concrete, sand, a quick setting foam, or some similar substance. Likewise, an industrial glue could be used on the mating surfaces C' and R before they are brought into engagement with one another to provide a stronger structure. If desired, after the connecting hubs are assembled, a hole could be drilled therethrough and a standard type nut and bolt assembly could be utilized to hold it together. Once the entire frame has been assembled, a number of different materials (not shown) could be used to enclose it. These materials, such as a plastic tarpaulin material, precut panels or the like, would be apparent to an individual skilled in the art.

It is to be understood that the present invention is not limited to the sole embodiment described above, but encompasses any and all embodiments within the scope of the following claims.

I claim:

1. A modular frame construction assembly comprising:

a plurality of tubular connecting members;

a generally circular ring having an outer annular surface defining two generally circular protruding flanges, a wall proximate to and located between said flanges, and a central, generally circular opening defining an aperture through said wall;

a plurality of generally semi-hemispherical portions, each portion having an outer semi-hemispherical wall and an indented portion; and a plurality of rounded protruding members located on said outer semi-hemispherical wall and said outer annular surface; wherein each of said tubular connecting members further includes two ends, each of said ends having means to engage said rounded protruding members, whereby the circular ring and the semi-hemispherical portions are adjustably engageable with one another to form a connecting hub, wherein said rounded protruding members are engageable with the tubular connecting members to fixedly interconnect a plurality of connecting hubs, thereby forming a structural frame.

2. The modular frame construction assembly according to claim 1, wherein said tubular connecting members are hollow.

3. The modular frame construction assembly according to claim 1, wherein said plurality of rounded protruding members located on said outer annular surface are spaced apart at 45° intervals.

4. A modular frame construction assembly comprising:

a plurality of generally spheroidal connecting hubs, each said connecting hub having a center point and further comprising;

a generally circular ring having a plurality of protruding flanges defining an outer annular surface, a wall proximate to and located between said flanges, and a central, generally circular opening defining an aperture through said wall;

a pair of generally semi-hemispherical portions, each portion having an outer semi-hemispherical wall and an indented portion matingly engageable with one of said protruding flanges located on said ring;

a plurality of rounded protruding members located on said outer semi-hemispherical wall and said outer annular surface, said protruding members located on said outer semi-hemispherical wall lie generally in a plane regular to each other and passing through said center point of said connecting hub; and a plurality of tubular connecting members, each of said tubular connecting members further including two ends, each of said ends having means to engage said rounded protruding members, whereby said connecting hubs and said tubular members are engageable with each other to fixedly interconnect a plurality of said connecting hubs, thereby forming a structural frame.

5. The modular frame construction assembly according to claim 4 wherein said tubular connecting members are hollow.

6. The modular frame construction assembly according to claim 4, wherein said plurality of rounded protruding members located on said outer annular surface are spaced apart at 45° intervals.

* * * * *